United States Patent [19]

Yano et al.

[11] 4,415,088

[45] Nov. 15, 1983

[54] CYLINDER-TYPE ROTARY SORTING APPARATUS

[75] Inventors: Noriyuki Yano, Kochi; Satoru Yahashi; Kanzo Shimazaki, both of Nangoku, all of Japan

[73] Assignees: Seirei Industry Company Limited, Okayama; Yanma Agricultural Equipment Company Limited, Osaka, both of Japan

[21] Appl. No.: 279,727

[22] Filed: Jul. 2, 1981

[30] Foreign Application Priority Data

Dec. 18, 1980 [JP] Japan ..... 55-179965
Dec. 22, 1980 [JP] Japan ..... 55-182656
Dec. 22, 1980 [JP] Japan ..... 55-185224[U]

[51] Int. Cl.[3] ..... B07B 13/04
[52] U.S. Cl. ..... 209/687; 209/684
[58] Field of Search ..... 209/687, 684, 689, 690; 130/13

[56] References Cited

U.S. PATENT DOCUMENTS 2,047,508 7/1936 Ingraham ..... 209/687 X
2,191,843 2/1940 Bloc ..... 209/687

FOREIGN PATENT DOCUMENTS 484686 10/1929 Fed. Rep. of Germany ..... 209/687

*Primary Examiner*—Robert B. Reeves
*Assistant Examiner*—Donald Hajec
*Attorney, Agent, or Firm*—Fisher, Christen & Sabol

[57] ABSTRACT

A machine for hulled grain employs a single horizontally disposed rotating hollow cylindrical body having its interior surface covered with a multiplicity of recesses designed to scoop up individual hulled grains at the bottom and to drop them out near the top. A partition separates the body into two compartments and two troughs containing screw conveyors extend the length of the cylindrical body and an arrangement of longitudinally extending plates are combined with the partition so that in the first compartment one of the conveying troughs brings the grains from a huller to the far end of the compartment while the other conveying trough catches the dropped grains and carries them to the far end of the second compartment and discharges them at that point to the bottom of the cylindrical body for re-sorting while the first conveying trough in the second compartment catches the re-sorted grains as they drop from above and carries them on to be discharged at the far end of the cylindrical body.

19 Claims, 8 Drawing Figures

CYLINDER-TYPE ROTARY SORTING APPARATUS

BACKGROUND OF THE INVENTION

This invention relates to a cylinder-type rotary sorting apparatus and more particularly to such machine of the type which performs first and second sorting operations simultaneously.

BRIEF SUMMARY OF THE INVENTION

It is a primary object of the invention to provide a cylinder-type rotary sorting apparatus which has first and second sorting segments operable concurrently to ensure highly efficient sorting operation.

It is another object of the invention to provide a cylinder-type rotary sorting apparatus which is of simple and compact construction and in which unsorted grains flowing on the inner periphery of a sorter cylinder, in first and second sorting segments, are caused to travel in the same direction so that they can be readily fed for re-sorting operation without the provision of any separate transport means.

It is a further object of the invention to provide a sorting apparatus, as above, in which unnecessary spillover or inflow of unsorted grains from one sorting segment into the other can be effectively prevented and a certain thickness of layers of unsorted grains can be obtained at the end of each sorting cycle, in order to facilitate sorting operation.

BRIEF DESCRIPTION OF THE DRAWINGS

The accompanying drawings illustrate embodiment of the invention by way of example. In the drawings.

Figure 1:
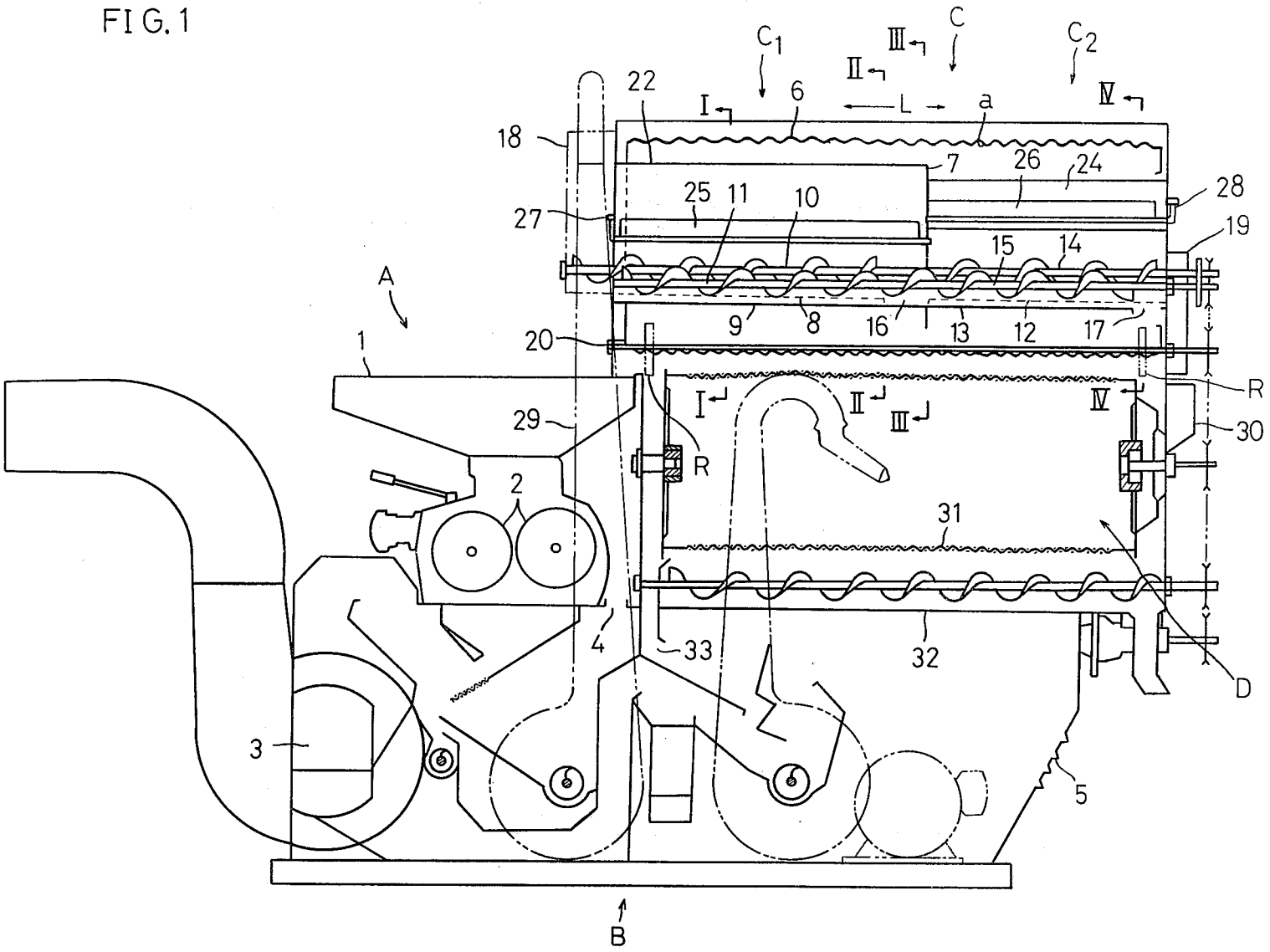
FIG. 1 is a side view showing the interior structure of a rice huller assembly incorporating a cylinder-type rotary sorting apparatus according to the invention.
Figure 2:
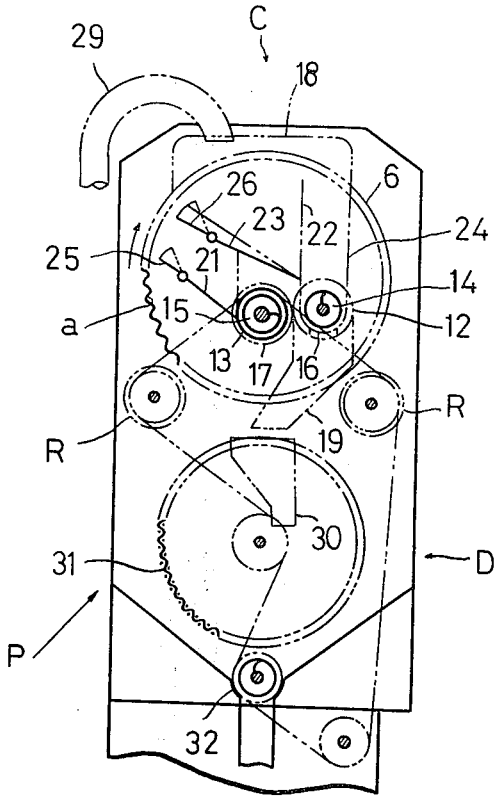
FIG. 2 is a rear view showing important aspects of the apparatus.
Figure 3:
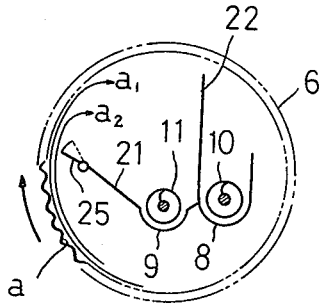
FIG. 3 is a sectional view taken on line I—I in FIG. 1.

The invention will now be described in detail with reference to the accompanying drawings showing a preferred embodiment of the invention. In the embodiment, a cylinder-type rotary sorting apparatus is shown as such incorporated in a rice huller assembly, which includes hulling segment A consisting essentially of an unhulled rice tank 1 and a pair of hulling rolls 2, winnowing segment B having a structure rectangularly extending from front side to rear side, and a rice sorter D. The cylinder-type rotary sorting apparatus is designated C. The winnowing segment B looks after winnowing of hulled rice grains from the hulling segment A and of unpolished rice grains as sorted out by the rotary sorting apparatus C and separated from broken and crushed rice grains by the rice sorter D, by exposing them to currents of air introduced by suction means 3 at the front portion of the winnowing segment through suction ports 4, 5 suitably provided on upper and rear walls of the segment B. The rotary sorting apparatus C sorts out ex-huller rice grains (mixtures of unpolished rice grains and unhulled rice grains) as hulled by the hulling segment A and then winnowed by the winnowing segment B, into unpolished rice grains and unhulled rice grains.

These segments, that is, hulling segment A, winnowing segment B, cylinder-type rotary sorting apparatus C, and rice sorter D, are integrally arranged into one complete assembly, with said hulling segment A placed above the front portion of the winnowing segment B, and the rotary sorting apparatus C and the rice sorter D, the former on top of the latter, above the rear portion of the winnowing segment B. Referring now to the cylinder-type rotary sorting apparatus in particular, numeral 6 designates a sorter cylinder having a multiplicity of recesses a provided on its inner periphery and which, at both sides thereof, are supported by rollers R so as to be rotatable in substantially horizontal position, the longitudinal direction L of said sorter cylinder 6 being at right angle to the axes of said hulling rolls 2. In the sorter cylinder 6 there is centrally provided a partition plate 7 which divides the sorter cylinder 6 into two portions, namely, first sorting segment C1, left-hand-side half portion, and second sorting segment C2, right-hand-side half portion. The partition plate, as FIG. 5 indicates, has a notched portion b, slightly spaced apart from the bottom part thereof in the direction of movement (the direction of the arrow in FIG. 5) of said sorter cylinder 6, for enabling unsorted grains to be passed from the ending stage of a sorting cycle in the second sorting segment C2 into the beginning stage of a sorting cycle in the first sorting segment C1. Indicated as 8 and 9 are a first transport trough and a first receiving trough respectively provided in the first sorting segment C1 in parallel relation to the longitudinal direction L of the sorter cylinder 6; they incorporate transport-purpose screw conveyors 10 and 11 respectively. Second receiving trough 12 and second transport trough 13 are provided along extensions of said first transport trough 8 and first receiving trough 9 respectively in the second sorting segment C2. The second receiving trough 12 incorporates a screw conveyor 14 whose axis is an extension of the axis of the screw conveyor 10 incorporated in the first transport trough 8. The interior of the second transport trough 13 and the interior of the first receiving trough 9 communicate with each other passing through the partition plate 7; and the second transport trough 13 incorporates a screw conveyor 15 whose axis is an extension of the axis of the screw conveyor 11 provided in the first receiving trough 9. The first transport trough 8 in the first sorting segment C1 has, at its terminal end or adjacent the partition plate 7, a first feed opening 16, and the second transport trough 13 in the second sorting segment C2 has at its terminal end a second feed opening 17. The beginning end of the first transport trough 8 communicates with the bottom of an ex-huller-rice-grain tank 18 mounted on the outer side wall of the rotary sorting apparatus C, on the first sorting-segment side; and the terminal end of the second receiving trough 12 communicates with the top of an unpolished-rice trough 19 mounted to the outer side wall of the sorting apparatus C, on the second sorting-segment side. A discharge end for discharge of unhulled rice grains from the first sorting segment C1 in the sorter cylinder 6 is positioned above the unhulled rice-grain tank 1.

In the first receiving trough 9 of the first sorting segment C1 there is provided a receiving side plate 21 which extends upwardly at a certain angle. Between the first transport trough 8 and the first receiving trough 9 there is uprightly mounted a collecting plate 22. In the second receiving trough 12 of the second sorting segment C2 there is provided a receiving flow plate 23 which extends in the same direction as the receiving side plate 21 in the first receiving trough 9. A receiving plate 24 is provided uprightly on the second receiving trough 12 on the upper side in the direction of rotation of the sorter cylinder 6. On the receiving side plate 21 and receiving flow plate 23, at their respective upper ends, there are mounted adjuster plates 25 and 26, whose angle of inclination is pivotally adjustable about their respective lower edges. Shown at 27 and 28 are adjusting levers for adjusting the angle of inclination of these adjuster plates 25, 26.

Figure 4:
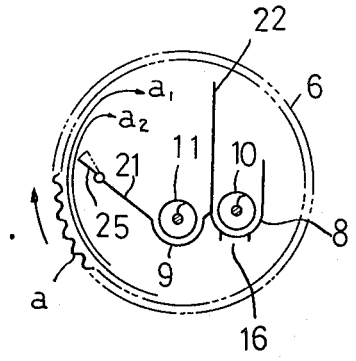
FIG. 4 is a section taken on line II—II in FIG. 1.
Figure 6:
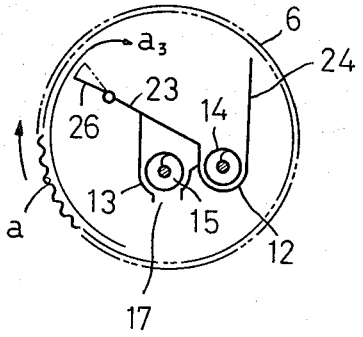
FIG. 6 is a section taken on line IV—IV in FIG. 1.
Figure 7:
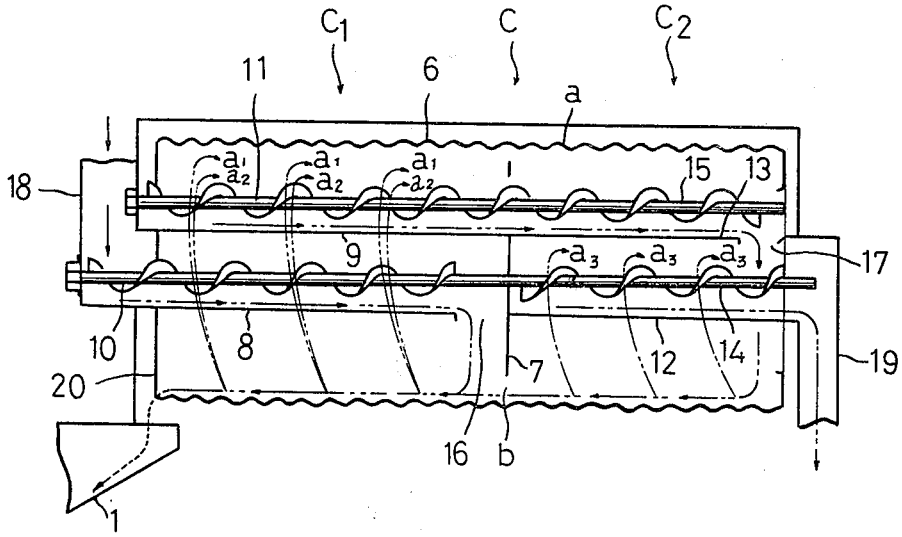
FIG. 7 is a schematic illustration of the operation of the invention as taken in the direction of the arrow p in FIG. 2.

Accordingly, unhulled rice grains as fed into the unhulled-rice-grain tank are hulled by the pair of rolls 2, and the hulled rice grains are cleaned of hulls and seconds by currents of air introduced by the suction means 3. The resulting rice grains (which still include unhulled grains in addition to unpolished rice grains and is herein referred to as "ex-huller rice grains") are hoisted by an ex-huller rice-grain thrower 29 and stored in an ex-huller rice-grain tank 18. Then, the ex-huller rice grains are transported by means of the screw conveyor 10 in the first transport trough 8 and fed, through the first feed opening 16 at the terminal end of said first transport trough 8, onto the inner periphery of the first sorting segment C1 of the sorter cylinder 6 which rotates, supported by the rollers R. Unhulled grains in the ex-huller grains so fed are allowed to float on layers of unpolished rice grains by rough surfaces defined by a multiplicity of recesses a, while unpolished rice grains allowed to sink into lower layers are caught and scooped up by the recesses a. An unpolished rice grains are scooped up, unhulled grains are allowed to ascend, then descend. Thus, unhulled grains gradually move toward the discharge end 20 while repeating such process of flow. From an idealistic point of view it may be thought that as above mentioned, unhulled grains should move toward the discharge end 20 without being scooped up, while unpolished rice grains are scooped up by the recesses a. Generally, unhulled rice grains are larger in size then unpolished rice grains, and therefore, if they are caught by the recesses a, they are more likely to get out of the recesses a than otherwise. As FIGS. 4 and 7 illustrate, all the unpolished rice grains as scooped up by the recesses a drop on to the receiving side plate 21 tracing a circular arc as indicated by the arrow a-1 and move into the first receiving trough 9. And there are often cases where some of the unhulled grains are scooped up in manner as shown by the arrow a2 to mix into unpolished rice grains as scooped up in manner as shown by the arrow a-1. Most unhulled rice grains which have not been scooped up are returned through the discharge end 20 into the unhulled-grain tank 1 for unhulling treatment. Whilst, mixtures of unpolished rice grains and unhulled rice grains as allowed to move into the first receiving trough 9 are transported into the second sorting segment C2 by the screw conveyor 11 passing through the partition plate 7, and after being moved through the second transport trough 13, they are fed, through the second feed opening 17 at the terminal end of the second transport trough 13, onto the inner periphery of the second sorting segment C2 of the sorter cylinder 6. The mixture grains so supplied are subjected to substantially the same scooping-up process as carried out in the first sorting segment C1. Unpolished rice grains only are scooped up in manner as shown by the arrow a3 in FIGS. 6 and 7, being allowed to drop onto the receiving flow plate 23. The unpolished rice grains are then passed through the second receiving trough 12, being directed along their further path through the unpolished-rice-grain trough 19. Unhulled rice grains and a small quantity of unpolished rice grains—which have not been scooped up—are checked by the lower portion of the partition plate 7 from movement therebeyond. Thus, while being so retained, they float to and fro to facilitate sorting operation at the final stage of a cycle in the second sorting segment C2. As the amount of unsorted grains in the second sorting segment C2 increases, a part of the unsorted grains is allowed to flow through the notched portion b into the beginning stage of operation in the sorting segment C1 to join unhulled grains fed through the first feed opening 16 for cycle sorting operation with sorting treatment in the first sorting C1.

Those unpolished rice grains which have been passed through the second receiving trough 12 are introduced through the unpolished-rice-grain trough 19 into a receiving funnel 30 and then subjected to sorting by means of a revolving cylinder 31 provided with a suitable screen or meshed iron plate. Waste rice grains are discharged through a discharge trough 32. Regular grains which have not passed through the meshes of the screen or meshed iron plate are introduced into the winnowing segment B through a flow passageway 33, and after being cleaned of fine dust by currents of air, they are stored in a specified vessel.

Figure 5:
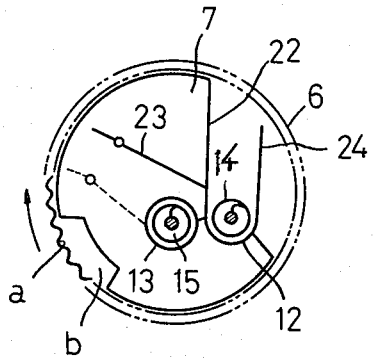
FIG. 5 is a view in section taken on line III—III in FIG. 1.

To the extent that it is shown in FIG. 5, the partition plate 7 does not cover some space around the second receiving trough on the first sorting segment side, some space thereabove, and some space on the back side of the receiving plate 24. If the partition is complete enough to cover these parts, there will be no spillover of unsorted grains from the first sorting segment C1 into the second sorting segment C2.

Figure 8:
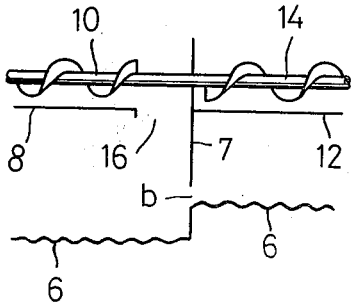
FIG. 8 is a view illustrating a modified form of an important aspect of the invention.

Also, it may be added that if, as FIG. 8 shows, the diameter of the sorter cylinder 6 in the first sorting segment C1 is made larger to provide some difference in level at the border between the first and second sorting segment C1 and C2, or at the location of the partition plate 7, ex-huller grains, as they drop from the first feed opening 16, may be prevented from flowing into the second sorting segment C2. Provision of such difference in level will also facilitate passage of unsorted grains from the end of a cycle in the second sorting segment C2 into the beginning stage of a cycle in the first sorting state C1, and help improve efficiency of sorting operation in the first sorting segment C1.

As described above, the cylinder-type rotary sorting apparatus in accordance with the invention performs first sorting operations and second re-sorting operations concurrently, both operations being carried out in one sorter cylinder. Therefore, no independent transport system is required for transporting sorted grains from first sorting stage for further sorting operation. This means simplified construction of the apparatus. Moreover, the first and second sorting segments operate in cooperation with each other, which fact means high sorting performance and yet ensures high sorting accuracy and compactness of apparatus.

Unsorted grains in the second sorting segment are passed into the first sorting segment for cycle sorting operation with resorting. Therefore, such unsorted grains can be completely sorted without sorting by a separate unit. This permits greater compactness of apparatus.

Moreover, the provision of a partition plate prevents spillover or flow of unsorted grains from one sorting segment to another, so that the possibility of sorting operation being interfered by such development can be eliminated and so that flow of unsorted grains at the final stage of a cycle in the second sorting segment can be suitably checked, thereby appropriate thickness of unsorted-grain layer is secured for effective sorting operation.

What is claimed is:

1. A cylinder-type rotary sorting apparatus including a sorter cylinder (6) substantially horizontally and rotably disposed which, on the inner periphery thereof, has a multiplicity of recesses (a), and receiving troughs provided in said sorter cylinder (6) for removal of sorted grains as scooped up by said recesses (a), wherein one half portion, left-hand side, of said sorter cylinder (6) constitutes a first-sorting segment (C1) and the other half portion, right-hand side, of said cylinder (6) constitutes a second sorting segment (C2) in which partially sorted grains as sorted out in said first sorting segment (C1) are re-sorted, and wherein means is provided for recycling unsorted grains from said second sorting segment (C2) to said first sorting segment (C1) for another cycle of sorting operation.

2. A cylinder-type rotary grain sorting apparatus as claimed in claim 1, wherein a partition plate (7) is provided substantially centrally in said sorter cylinder (6) to divide same into the first sorting segments (C1) and the second sorting segments (C2), said partition plate (7) having a notched portion (b), slightly spaced away from the bottom part, so that at the end of each sorting cycle in the second sorting segment (C2) unsorted grains can be moved into the beginning stage of the cycle in the first sorting segment (C1) for re-sorting.

3. A cylinder-type rotary sorting apparatus including a sorter cylinder (6) substantially horizontally and rotatably disposed which, on the inner periphery thereof, has a multiplicity of recesses (a), and receiving troughs provided in said sorter cylinder (6) for removal of sorted grains as scooped up by said recesses, wherein a partition plate (7) is provided substantially centrally in said sorter cylinder (6) to divide same into two sorting segments (C1) and (C2), said partition plate (7) having a notched portion (b), slightly spaced apart from the bottom part thereof in the direction of movement of said sorter cylinder (6), for allowing unsorted grains to move from one sorting segment (C2) into the other sorting segment (C1).

4. In a cylinder type sorting apparatus for sorting grains that have been subject to the actions of a hulling mechanism, comprising:

a generally horizontal cylindrical body mounted for rotation about its principal axis and being axially subdivided into first and second cylindrical compartments;

the interior cylindrical wall of said body being provided with a multiplicity of recesses designed to scoop up individual hulled grains during travel in the lower portion of their rotary paths of movement and to drop them during travel in an upper portion of their paths of movement; and conveyor means for introducing hulled grains to the interior of said first compartment to be scooped up by said recesses, to receive grains dropped by said recesses in said first compartment, and to introduce said dropped grains into the interior of the second compartment to be scooped up again by the recesses in the said second compartment, said conveyor means includes means to receive grains dropped by the recesses in said second compartment and to discharge them outside of said cylindrical body, and;

means to feed grains from said hulling mechanism to said cylindrical body and, means to transfer grains not scooped up by any of said recesses back to said hulling mechanism.

5. Grain sorting apparatus according to claim 4, wherein said conveyor means includes a horizontally disposed first receiving trough means supported within the interior of said cylindrical body to receive grains dropped by said recesses along a portion of its length.

6. Grain sorting apparatus according to claim 5, wherein said conveyor means includes a horizontally disposed second receiving trough means supported within the interior of said cylindrical body to receive grains dropped by said recesses along a portion of its length and to discharge them therefrom.

7. Grain sorting apparatus according to claim 6, wherein said first receiving trough means is arranged to introduce grains into the second compartment.

8. Grain sorting apparatus according to claim 6, wherein both of said trough means include means to move grains in said trough means in the same direction along their entire lengths.

9. Grain sorting apparatus according to claim 8, wherein hulled grains from a hulling mechanism are introduced into said cylindrical body by said conveyor means at one end, and grains not scooped up by any of said recesses in either of said compartments are also discharged to said hulling mechanism at said one end for further subjection to hulling.

10. Grain sorting apparatus according to claim 4, wherein said cylindrical body is subdivided into first and second compartments by a generally radially extending partition means disposed medially of the length of said body and said first receiving trough means includes an upwardly extending collecting plate to assist in catching grains dropped in the first compartment.

11. Grain sorting apparatus according to claim 10, wherein said partition means is provided with an opening to permit grains in said first receiving trough means to be conveyed into the second compartment.

12. Grain sorting apparatus according to claim 11, wherein said conveyor means includes a first transport trough to convey grains received at one end of the cylindrical body from a hulling mechanism to the bottom of the first compartment at the end remote from said one end.

13. Grain sorting apparatus according to claim 10, wherein said first receiving trough means extends substantially the length of the cylindrical body and includes means to prevent grains dropped in the second compartment from entering said first receiving trough means.

14. Grain sorting apparatus according to claim 13, wherein said second receiving trough means includes upwardly extending plate means to assist in catching grains dropped in said second compartment and to discharge said caught grains at the exterior of said second compartment.

15. Grain sorting apparatus according to either one of claims 10 or 14, wherein said plate means extends longitudinally upwardly inclined from one side of a trough means and terminates at the upper end in a horizontally pivotal vane to adjust the level at which dropped grains will be received by the trough means.

16. Grain sorting apparatus according to claim 15, wherein said partition means is provided with a radially inwardly directed marginal recess to permit grains in the second compartment that are not scooped up by the recesses in the cylindrical wall to flow into the bottom of the first compartment.

17. Grain sorting apparatus according to claim 16, wherein the inner diameter of the first compartment is greater than that of the second compartment to assist said flow.

18. Grain sorting apparatus according to any one of claims 10, 11, 12, 13 or 14, wherein said partition means is provided with a radially inwardly directed marginal recess to permit grains in the second compartment that are not scooped up by the recesses in the cylindrical wall to flow into the bottom of the first compartment.

19. Grain sorting apparatus according to claim 18, wherein the inner diameter of the first compartment is greater than that of the second compartment to assist said flow.

* * * * *